US009702378B2

(12) United States Patent
Fujiwara et al.

(10) Patent No.: US 9,702,378 B2
(45) Date of Patent: Jul. 11, 2017

(54) CONTROL VALVE APPARATUS OF POWER SHOVEL

(71) Applicant: KAYABA INDUSTRY CO., LTD., Tokyo (JP)

(72) Inventors: Takeshi Fujiwara, Kanagawa (JP); Masayuki Nakamura, Kanagawa (JP); Chuka Sho, Shanghai (CN)

(73) Assignee: KYB Corporation, Tokyo (JP)

( * ) Notice: Subject to any disclaimer, the term of this patent is extended or adjusted under 35 U.S.C. 154(b) by 268 days.

(21) Appl. No.: 14/389,279

(22) PCT Filed: Mar. 18, 2013

(86) PCT No.: PCT/JP2013/057664
§ 371 (c)(1),
(2) Date: Sep. 29, 2014

(87) PCT Pub. No.: WO2013/146420
PCT Pub. Date: Oct. 3, 2013

(65) Prior Publication Data

US 2015/0089935 A1 Apr. 2, 2015

(30) Foreign Application Priority Data

Mar. 29, 2012 (JP) ..... 2012-076843

(51) Int. Cl.
*F15B 11/042* (2006.01)
*F15B 11/17* (2006.01)
*E02F 9/22* (2006.01)

(52) U.S. Cl.
CPC ..... *F15B 11/0426* (2013.01); *E02F 9/2239* (2013.01); *E02F 9/2267* (2013.01); *E02F 9/2285* (2013.01); *E02F 9/2292* (2013.01); *F15B 11/17* (2013.01); *F15B 2211/20576* (2013.01); *F15B 2211/30565* (2013.01);
(Continued)

(58) Field of Classification Search
CPC ..... E02F 9/2239; E02F 9/2267; E02F 9/2285; E02F 9/2292; F15B 11/0426; F15B 11/17; F15B 2211/20576; F15B 2211/30565; F15B 2211/30595; F15B 2211/329; F15B 2211/355; F15B 2211/45; F15B 2211/415; F15B 2211/428; F15B 2211/7107;
(Continued)

(56) References Cited

FOREIGN PATENT DOCUMENTS

JP 1993-058904 U 8/1993
JP 1993-321300 A 12/1993
(Continued)

*Primary Examiner* — Logan Kraft
(74) *Attorney, Agent, or Firm* — Rabin & Berdo, P.C.

(57) ABSTRACT

A control valve apparatus includes a second-working-actuator acceleration control valve connected to a first working control valve in parallel. The second-working-actuator acceleration control valve includes pilot chambers receiving a pilot pressure for switching first and second working control valves and a flow channel that guides a pressure fluid of a first pump port to an entrance port side of the second working control valve. The second-working-actuator acceleration control valve is switchable between a first priority position in which a pressure fluid is guided to the first working control valve with a higher priority than the second working control valve and a second priority position in which a pressure fluid is guided to the second working control valve with a higher priority than the first working control valve.

5 Claims, 3 Drawing Sheets

(52) U.S. Cl.
CPC ..... *F15B 2211/30595* (2013.01); *F15B 2211/329* (2013.01); *F15B 2211/355* (2013.01); *F15B 2211/415* (2013.01); *F15B 2211/428* (2013.01); *F15B 2211/45* (2013.01); *F15B 2211/7107* (2013.01); *F15B 2211/7135* (2013.01); *F15B 2211/7142* (2013.01); *F15B 2211/75* (2013.01); *F15B 2211/755* (2013.01); *F15B 2211/781* (2013.01)

(58) Field of Classification Search
CPC ..... F15B 2211/7135; F15B 2211/7142; F15B 2211/75; F15B 2211/755; F15B 2211/781
See application file for complete search history.

(56) References Cited

FOREIGN PATENT DOCUMENTS

| | | | |
|---|---|---|---|
| JP | H09-165796 | A | 6/1997 |
| JP | 2002-155907 | A | 5/2002 |
| JP | 2003-090302 | A | 3/2003 |
| JP | 2007-032589 | A | 2/2007 |
| JP | 2010-025146 | A | 2/2010 |
| KR | 2006-0043497 | A | 5/2006 |

CONTROL VALVE APPARATUS OF POWER SHOVEL

TECHNICAL FIELD

The present invention relates to a control valve apparatus of a power shovel provided with a bucket cylinder and an arm cylinder.

BACKGROUND ART

JP 2007-032589A discloses a control valve apparatus of a power shovel. In the control valve apparatus of the power shovel, a valve block includes a first pump port connected to a first pump and a second pump port connected to a second pump. In addition, the valve block includes a first hydraulic circuit system communicating with the first pump port and a second hydraulic circuit system communicating with the second pump port.

The first hydraulic circuit system is provided with a travel control valve that controls one of travel motors and a plurality of working control valves sequentially from the upstream side. The second hydraulic circuit system is provided with a straight-travel valve, a travel control valve that controls the other travel motor, and a plurality of working control valves sequentially from the upstream side.

The first hydraulic circuit system is provided with a supply channel connected to the first pump port and a neutral flow path that causes the supply channel to communicate with a tank port in a case where each control valve is in a neutral position. The supply channel is connected to a flow-dividing channel in the upstream side of the travel control valve. This flow-dividing channel is connected to the straight-travel valve of the second hydraulic circuit system. The supply channel connected to the second pump port is connected to the straight-travel valve.

When the straight-travel valve is in a normal position, the flow-dividing channel communicates with a parallel channel of the first hydraulic circuit system via the straight-travel valve. Each of the working control valves is connected in parallel via the parallel channel. The parallel channel communicates with the neutral flow path through a branching channel connected to the upstream side of the working control valve.

The second hydraulic circuit system is provided with a supply channel connected to the second pump port and a neutral flow path that causes the supply channel to communicate with a tank port in a case where each control valve is in a neutral position. The supply channel is connected to a parallel channel in the upstream side of the straight-travel valve. Each of the working control valves is connected in parallel via the parallel channel.

In a case where the straight-travel valve is in a normal position, the second pump port communicates with the neutral flow path provided in the downstream side of the straight-travel valve.

If the straight-travel valve switches to a switching position, the travel control valve of the first hydraulic circuit system and the travel control valve of the second hydraulic circuit system connected via the straight-travel valve are connected to the first pump port in parallel. Meanwhile, each parallel channel of the first and second hydraulic circuit systems is connected to the second pump port in parallel.

SUMMARY OF INVENTION

In the aforementioned control valve apparatus of the related art, only a pressure fluid from the second pump port is guided to the working control valves provided in the second hydraulic circuit system regardless of a position of the straight-travel valve.

Therefore, it is difficult to perform so-called acceleration control in which fluids from the first and second pump ports P1 and P2 are confluently supplied to working actuators connected to the working control valves.

An object of the present invention is to provide a control valve apparatus of a power shovel, capable of performing acceleration control for a working actuator connected to a working control valve provided in a second hydraulic circuit system.

According to one aspect of the present invention, a control valve apparatus of a power shovel includes a first hydraulic circuit system communicating with a first pump port connected to a first pump, a second hydraulic circuit system communicating with a second pump port connected to a second pump, a first working control valve provided in the first hydraulic circuit system to control a first working actuator, a second working control valve provided in the second hydraulic circuit system to control a second working actuator, and a second-working-actuator acceleration control valve provided in the first hydraulic circuit system and connected to the first working control valve in parallel. The second-working-actuator acceleration control valve includes a pair of pilot chambers, one pilot chamber receiving a pilot pressure for switching the first working control valve, the other pilot chamber receiving a pilot pressure for switching the second working control valve, and a flow channel that guides a pressure fluid from the first pump port to an entrance port side of the second working control valve. The second-working-actuator acceleration control valve is switchable between a first priority position in which a pressure fluid is guided to the first working control valve with a higher priority than the second working control valve by virtue of the pilot pressure of the one pilot chamber and a second priority position in which a pressure fluid is guided to the second working control valve with a higher priority than the first working control valve by virtue of the pilot pressure of the other pilot chamber.

Embodiments of the present invention and advantages thereof are described in detail below with reference to the accompanying drawings.

DESCRIPTION OF EMBODIMENTS

Hereinafter, embodiments of the present invention will be described with reference to the accompanying drawings.

Figure 1:
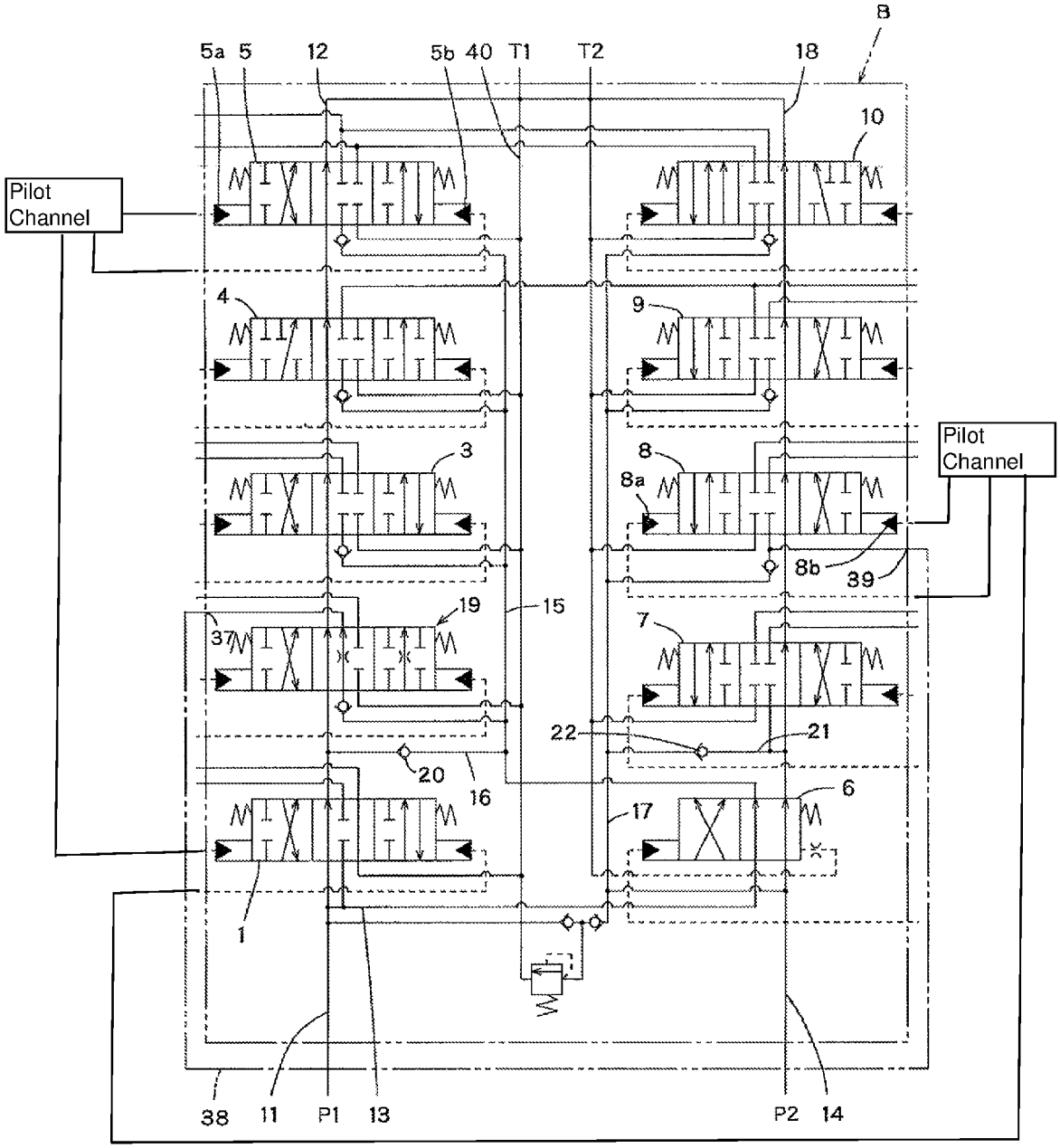
FIG. 1 is a circuit diagram illustrating a control valve apparatus of a power shovel according to an embodiment of the present invention.

FIG. 1 is a circuit diagram illustrating a control valve apparatus of a power shovel according to the present embodiment. A valve block B includes a first pump port P1 connected to a first pump (not illustrated) and a second pump port P2 connected to a second pump (not illustrated). In addition, the valve block B includes a first hydraulic circuit system communicating with the first pump port P1 and a second hydraulic circuit system communicating with the second pump port P2.

The first hydraulic circuit system includes, sequentially from the upstream side, a travel control valve 1 that controls one of travel motors, a bucket acceleration control valve 19 serving as a second-working-actuator acceleration control valve that performs acceleration control for the bucket cylinder serving as a second working actuator, a rotation control valve 3 that controls a rotation motor, a boom second-speed control valve 4 that performs acceleration control for a boom cylinder, and an arm control valve 5 serving as a first working control valve that controls an arm cylinder serving as a first working actuator.

The second hydraulic circuit system includes, sequentially from the upstream side, a straight-travel valve 6, a travel control valve 7 that controls the other travel motor, a bucket control valve 8 serving as a second working control valve that controls the bucket cylinder, a boom control valve 9 that controls the boom cylinder, and an arm second-speed control valve 10 that controls the arm cylinder.

The first hydraulic circuit system further includes a supply channel 11 connected to the first pump port P1 and a neutral flow path 12 that causes the supply channel 11 to communicate with a tank port T1 in a case where each control valve 1 to 5 is in a neutral position.

In the upstream side of the travel control valve 1, the supply channel 11 is connected to a flow-dividing channel 13. The flow-dividing channel 13 is connected to the straight-travel valve 6 of the second hydraulic circuit system. A supply channel 14 connected to the second pump port P2 is connected to the straight-travel valve 6. In a case where the straight-travel valve 6 is in a normal position as illustrated in the drawing, the flow-dividing channel 13 communicates with a parallel channel 15 of the first hydraulic circuit system via the straight-travel valve 6. The bucket acceleration control valve 19, the rotation control valve 3, the boom second-speed control valve 4, and the arm control valve 5 are connected in parallel with each other via the parallel channel 15.

The neutral flow path 12 communicates with the parallel channel 15 through a branching channel 16 connected to the upstream side of the bucket acceleration control valve 19. The branching channel 16 is provided with a check valve 20 that allows only a flow from the neutral flow path 12 to the parallel channel 15.

Therefore, in a case where the travel control valve 1 is in a neutral position as illustrated in the drawing and any one of the control valves 3, 4, 5, and 19 of the downstream side of the travel control valve 1 is switched, the fluid supplied from the first pump port P1 is guided to the parallel 15 through the neutral flow path 12 and the branching channel 16 from the travel control valve 1.

In addition, the supply channel 14 connected to the second pump port P2 is connected to a parallel channel 17 in the upstream side of the straight-travel valve 6. The control valves 7 to 10 are connected in parallel with each other via the parallel channel 17.

Therefore, in a case where the straight-travel valve 6 is in a normal position as illustrated in the drawing, the travel control valve 7 is in a neutral position as illustrated in the drawing, and any one of the control valves 8 to 10 of the downstream side of the travel control valve 7 is switched, the pressure fluid supplied from the second pump port P2 to the supply channel 14 is supplied to the parallel channel 17.

In a case where the straight-travel valve 6 is in a normal position as illustrated in the drawing, the supply channel 14 communicates with a neutral flow path 18 provided in the downstream side of the straight-travel valve 6. The neutral flow path 18 causes the supply channel 14 to communicate with the tank port T2 in a case where the straight-travel valve 6 is in a normal position as illustrated in the drawing, and each of the control valves 7 to 10 is in a neutral position.

The parallel channel 17 and the neutral flow path 18 communicate with each other through a branching channel 21, and the branching channel 21 is provided with a check valve 22. The check valve 22 allows only a flow from the parallel channel 17 to the neutral flow path 18.

If the straight-travel valve 6 switches to the left side position in the drawing, the travel control valve 1 of the first hydraulic circuit system and the travel control valve 7 of the second hydraulic circuit system connected via the straight-travel valve 6 are connected to the first pump port P1 in parallel. In addition, the parallel channels 15 and 17 are connected to the second pump port P2 in parallel.

Here, a control valve apparatus of a power shovel according to a comparative example, which is not according to the present invention, will be described with reference to FIG. 3. In the description of the comparative example, like reference numerals denote like elements as in the present embodiment.

Figure 3:
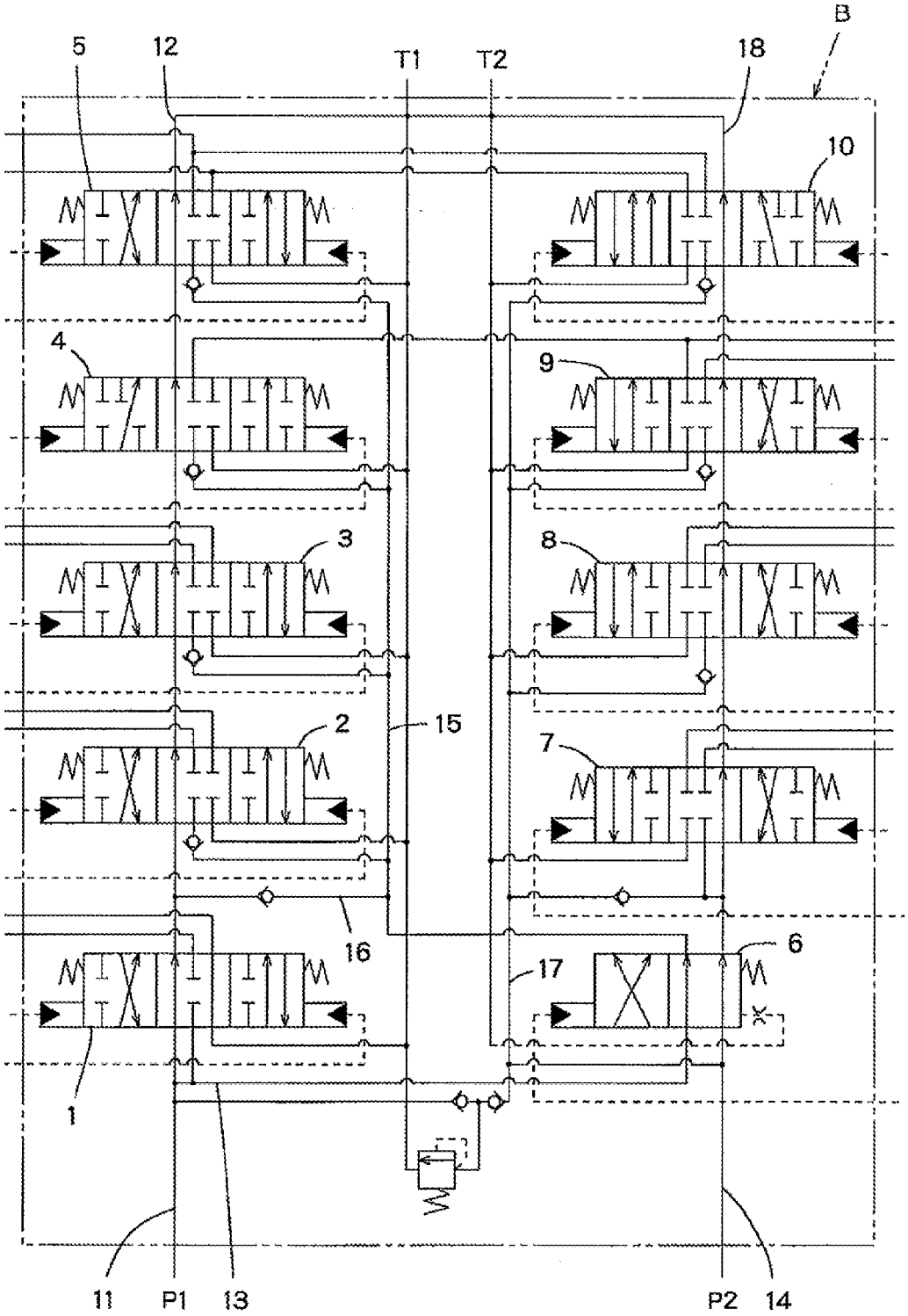
FIG. 3 is a circuit diagram illustrating a control valve apparatus of a power shovel in a comparative example.

As illustrated in FIG. 3, in the control valve apparatus of the power shovel, A valve block B includes a first pump port P1 connected to a first pump (not illustrated) and a second pump port P2 connected to a second pump (not illustrated). The valve block B includes a first hydraulic circuit system communicating with the first pump port P1 and a second hydraulic circuit system communicating with the second pump port P2.

The first hydraulic circuit system includes, sequentially from the upstream side, a travel control valve 1 that controls one of the travel motors, a auxiliary control valve 2 that controls a auxiliary actuator, a rotation control valve 3 that controls a rotation motor, a boom second-speed control valve 4 that controls a second-speed operation of a boom cylinder, and an arm control valve 5 that controls an arm cylinder.

The second hydraulic circuit system includes, sequentially from the upstream side, a straight-travel valve 6, a travel control valve 7 that controls the other travel motor, a bucket control valve 8 that controls a bucket cylinder, a boom control valve 9 that controls a boom cylinder, and an arm second-speed control valve 10 that controls a second-speed operation of an arm cylinder.

The first hydraulic circuit system further includes a supply channel 11 connected to the first pump port P1 and a neutral flow path 12 that causes the supply channel 11 to communicate with a tank port T1 in a case where each of the control valves 1 to 5 is in a neutral position.

The supply channel 11 is connected to a flow-dividing channel 13 in the upstream side of the travel control valve 1. The flow-dividing channel 13 is connected to the straight-travel valve 6 of the second hydraulic circuit system. The supply channel 14 connected to the second pump port P2 is connected to the straight-travel valve 6. In a case where the straight-travel valve 6 is in a normal position as illustrated in the drawing, the flow-dividing channel 13 communicates with a parallel channel 15 of the first hydraulic circuit system via the straight-travel valve 6. The auxiliary control valve 2, the rotation control valve 3, the boom 2-speed control valve 4, and the arm control valve 5 are connected in parallel with each other via the parallel channel 15.

The neutral flow path 12 communicates with the parallel channel 15 through the branching channel 16 connected to the upstream side of the auxiliary control valve 2.

The supply channel 14 connected to the second pump port P2 is connected to a parallel channel 17 in the upstream side of the straight-travel valve 6. Each of the control valves 7 to 10 is connected in parallel with each other via parallel channel 17.

In a case where the straight-travel valve 6 is in a normal position as illustrated in the drawing, the second pump port P2 also communicates with the neutral flow path 18 provided in the downstream side of the straight-travel valve 6. The neutral flow path 18 causes the supply channel 14 to communicate with the tank port T2 in a case where the straight-travel valve 6 is in a normal position as illustrated in the drawing, and each of the control valves 7 to 10 is in a neutral position.

If the straight-travel valve 6 switches to the left side position in the drawing, the travel control valve 1 of the first hydraulic circuit system and the travel control valve 7 of the second hydraulic circuit system connected via the straight-travel valve 6 are connected to the first pump port P1 in parallel. In addition, the parallel channels 15 and 17 are connected to the second pump port P2 in parallel.

Therefore, only a pressure fluid from the second pump port P2 is guided to the bucket control valve 8 regardless of a position of the straight-travel valve 6. As a result, it is difficult to perform acceleration control in which fluids from the first and second pump ports P1 and P2 are confluently supplied to the bucket cylinder connected to the bucket control valve 8. Therefore, it is difficult to accelerate a pivot operation of the bucket.

In this regard, according to the present embodiment, the bucket acceleration control valve 19 is provided in place of the auxiliary control valve 2 of the comparative example.

Figure 2:
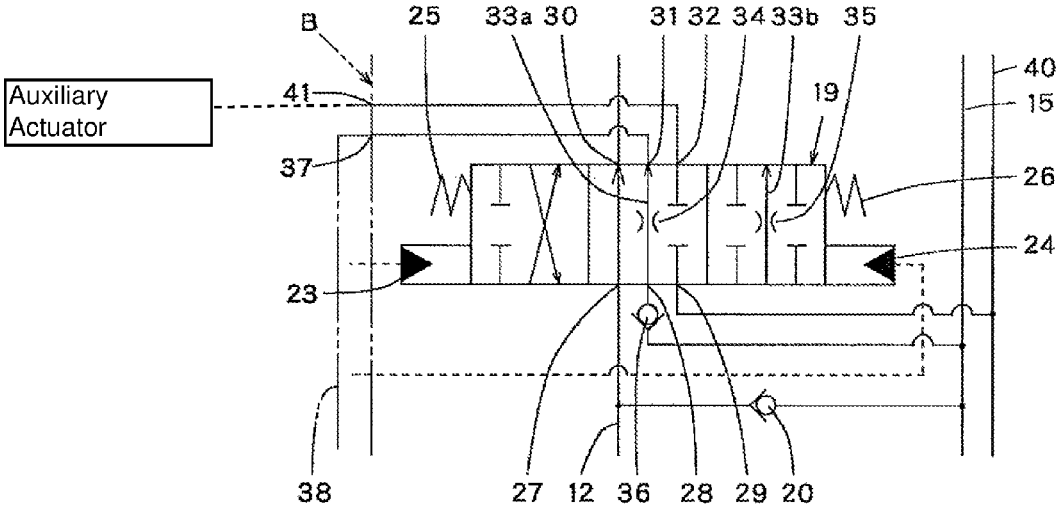
FIG. 2 is an enlarged view illustrating a bucket acceleration control valve of FIG. 1.

FIG. 2 is an enlarged view illustrating the bucket acceleration control valve 19.

The bucket acceleration control valve 19 includes pilot chambers 23 and 24 and center springs 25 and 26 in both sides.

The pilot chamber 23 communicates with the pilot chambers 5*a* and 5*b* of the arm control valve 5 via a pilot channel. Therefore, as the pilot pressure is guided to the pilot chambers 5*a* and 5*b* for the purpose of switching the arm control valve 5, the pilot pressure is also guided to one of the pilot chambers 23 of the bucket acceleration control valve 19.

The other pilot chamber 24 communicates with the pilot chambers 8*a* and 8*b* of the bucket control valve 8 via a pilot channel. Therefore, as the pilot pressure is guided to the pilot chambers 8*a* and 8*b* for the purpose of switching the bucket control valve 8, the pilot pressure is also guided to the other pilot chamber 24 of the bucket acceleration control valve 19.

In addition, the bucket acceleration control valve 19 is a 3-position 6-port valve and has first to third ports 27 to 29 in one side and fourth to sixth ports 30 to 32 in the other side.

The first and fourth ports 27 and 30 are used to open/close the neutral flow path 12. In a case where the bucket acceleration control valve 19 is in a neutral position as illustrated in the drawing, the first and fourth ports 27 and 30 communicate with each other. Meanwhile, in a case where the bucket acceleration control valve 19 is in any one of left and right switching positions as illustrated in the drawing, communication with the first and fourth ports 27 and 30 is disconnected.

In a case where the bucket acceleration control valve 19 is in a neutral position as illustrated in the drawing, the second port 28 communicates with the fifth port 31, and a flow channel 33*a* is formed in the process of the communication. Meanwhile, as the bucket acceleration control valve 19 switches to the right side position in the drawing, the second port 28 communicates with the fifth port 31 via the flow channel 33*b*.

The neutral position is an arm priority position as a first priority position, and the right side position in the drawing is a bucket priority position as a second priority position. In the arm priority position as the neutral position, a first flow restriction portion 34 is formed. In the bucket priority position as the right side position, a second flow restriction portion 35 is formed. An opening rate of the first flow restriction portion 34 is set to be lower than that of the second flow restriction portion 35.

However, the opening rates of the first and second flow restriction portions 34 and 35 change as a spool (not illustrate) moves between the arm priority position and the bucket priority position.

The parallel channel 15 communicates with the second port 28 via a load check valve 36. The load check valve 36 allows only a flow from the parallel channel 15 to the second port 28.

The fifth port 31 communicates with one port 37. In contrast, in the comparative example the auxiliary control valve 2 is communicated with the one port 37. The port 37 is connected to an entrance port 39 of the bucket control valve 8 via an external line 38 provided in the outside of the valve block B.

The third port 29 is connected to a first tank port T1 via the tank channel 40, and the sixth port 32 communicates with the other port 41. In contrast, in the comparative example the auxiliary control valve 2 is communicated with the other port 41. The port 41 is connected to the auxiliary actuator via a control valve (not illustrated) provided in the outside of the valve block B.

In a case where the bucket acceleration control valve 19 is in an arm priority position as a neutral position illustrated in the drawing, the first flow restriction portion 34 having a relatively smaller capacity is opened. Therefore, the amount of the pressure fluid supplied to the bucket cylinder having a relatively smaller load through the external line 38 from the parallel channel 15 of the first hydraulic circuit system is restricted. Therefore, the fluid amount supplied to the control valves 3 to 5 provided in the first hydraulic circuit system has a higher priority than that of the fluid amount supplied to the bucket control valve 8 for the purpose of the bucket acceleration control.

In a case where the bucket acceleration control valve 19 is in an arm priority position, the flow channel 33*a* may be completely closed instead of opening the first flow restriction portion 34 as described above. As the flow channel 33*a* is closed, the fluid amount for acceleration control is not supplied to the bucket cylinder at all. Therefore, it is possible to supply the pressure fluid to the control valves 3 to 5 provided in the first hydraulic circuit system with a higher priority.

Subsequently, as the pilot pressure is guided to any one of the pilot chambers 8*a* and 8*b* for the purpose of switching the bucket control valve 8 of the second hydraulic circuit system while the arm cylinder is not operated, the pilot pressure is guided to the pilot chamber 24 of the bucket acceleration control valve 19. The bucket acceleration control valve 19 switches to the bucket priority position, which is the right side position in the drawing, by virtue of the pilot pressure of the pilot chamber 24.

As the bucket acceleration control valve 19 switches to the bucket priority position, the second flow restriction portion 35 having a relatively larger opening rate than that of the first flow restriction portion 34 is opened. Due to the higher opening rate, the more acceleration control fluid amount is supplied to the entrance port 39 of the bucket control valve 8.

In a case where the arm control valve 5 is switched to actuate the arm cylinder while the bucket acceleration control valve 19 is maintained in the bucket priority position as described above, that is, in a case where both the arm cylinder and the bucket cylinder are simultaneously actuated, the pilot pressure guided to the pilot chamber 5*a* or 5*b* of the arm control valve 5 is guided to the pilot chamber 23 of the bucket acceleration control valve 19.

As a result, since the pilot pressure is guided to each of both the pilot chambers 23 and 24 of the bucket acceleration control valve 19, the bucket acceleration control valve 19 switches to a position between the bucket priority position and the arm priority position, where an effect of the pilot pressure of the pilot chamber 24 and an effect of the pilot pressure of the pilot chamber 23 are balanced, based on a balance between the pilot pressures of the pilot chambers 23 and 24. In this case, in a case where the pilot pressure of the pilot chamber 23 is sufficiently higher than the pilot pressure of the pilot chamber 24, the bucket acceleration control valve 19 is returned to the arm priority position which is the neutral position in the drawing. In this manner, in a case where both the arm cylinder and the bucket cylinder are simultaneously actuated, the bucket acceleration control valve 19 switches to the arm priority position side depending on the pressure difference between the pilot pressure of the pilot chamber 23 and the pilot pressure of the pilot chamber 24.

In a case where the arm control valve 5 is switched to actuate the arm cylinder while the bucket acceleration control valve 19 is maintained in the arm priority position, the bucket acceleration control valve 19 switches to the left side position in the drawing. As a result, the pressure fluid of the parallel channel 15 is supplied to the auxiliary actuator through the other port 41. The pressure fluid inside the external line 38 communicating with the bucket control valve 8 flows to the first tank port T1 through the tank channel 40.

According to the aforementioned embodiment, it is possible to obtain the following effects.

In a case where the bucket control valve 8 provided in the second hydraulic circuit system is switched, the bucket acceleration control valve 19 provided in the first hydraulic circuit system is maintained in the bucket priority position. Therefore, it is possible to perform acceleration control for the bucket cylinder by joining the pressure fluid supplied to the first hydraulic circuit system to the bucket control valve 8.

If the arm control valve 5 is switched to actuate the arm cylinder, the bucket acceleration control valve 19 is maintained in the arm priority position. Therefore, it is possible to prevent the pressure fluid from being supplied to the bucket cylinder having a low load with a high priority and reliably control the arm cylinder.

In addition, the first flow restriction portion 34 is provided in the flow channel 33*a* in the arm priority position of the bucket acceleration control valve 19, and the second flow restriction portion 35 is provided in the flow channel 33*b* in the bucket priority position in order to control the opening rates of the flow channels 33*a* and 33*b*. Therefore, it is possible to perform control depending on the opening rates of the first and second flow restriction portions 34 and 35.

In addition, in a case where the pilot pressure is applied to both the pilot chambers 23 and 24 of the bucket acceleration control valve 19, the bucket acceleration control valve 19 switches to a balanced position between the arm priority position and the bucket priority position depending on the pilot pressures of the pilot chambers 23 and 24. Therefore, it is possible to perform control in a priority position depending on operational conditions of the arm control valve 5 and the bucket control valve 8.

Furthermore, since the auxiliary control valve 2 of the comparative example is substituted with the bucket acceleration control valve 19, it is possible to utilize the valve block B of the comparative example. Therefore, it is possible to remarkably lower the setup cost of the bucket acceleration control valve 19.

Furthermore, since the bucket acceleration control valve 19 is provided with a switching position for controlling the auxiliary actuator, it is possible to perform control of the auxiliary actuator as well as acceleration control of the bucket cylinder.

Embodiments of this invention were described above, but the above embodiments are merely examples of applications of this invention, and the technical scope of this invention is not limited to the specific constitutions of the above embodiments.

This application claims priority based on Japanese Patent Application No. 2012-076843 filed with the Japan Patent Office on Mar. 29, 2012, the entire contents of which are incorporated into this specification.

The invention claimed is:

1. A control valve apparatus of a power shovel, comprising:

a first hydraulic circuit system communicating with a first pump port connected to a first pump;

a second hydraulic circuit system communicating with a second pump port connected to a second pump;

a first working control valve provided in the first hydraulic circuit system to control a first working actuator;

a second working control valve provided in the second hydraulic circuit system to control a second working actuator; and a second-working-actuator acceleration control valve provided in the first hydraulic circuit system and connected to the first working control valve in parallel, wherein the second-working-actuator acceleration control valve includes a pair of pilot chambers, one of the pair of pilot chambers receiving a pilot pressure for switching the first working control valve, the other of the pair of pilot chambers receiving a pilot pressure for switching the second working control valve, and a flow channel that guides a pressure fluid from the first pump port to an entrance port side of the second working control valve, and the second-working-actuator acceleration control valve is switchable between a first priority position in which a pressure fluid is guided to the first working control valve with a higher priority than the second working control valve by virtue of the pilot pressure of the one pilot chamber, and a second priority position in which a pressure fluid is guided to the second working control valve with a higher priority than the first working control valve by virtue of the pilot pressure of the other pilot chamber.

2. The control valve apparatus of the power shovel according to claim 1, wherein the second-working-actuator acceleration control valve includes a first flow restriction portion provided in the flow channel in a case of the first priority position and a second flow restriction portion provided in the flow channel in a case of the second priority position, and an opening rate of the first flow restriction portion is lower than that of the second flow restriction portion.

3. The control valve apparatus of the power shovel according to claim 1, wherein, in a case where the pilot pressure is applied to both the pilot chambers of the second-working-actuator acceleration control valve, the second-working-actuator acceleration control valve switches to a position between the first and second priority positions, where an effect of the pilot pressure of the one pilot chamber and an effect of the pilot pressure of the other pilot chamber are balanced.

4. The control valve apparatus of the power shovel according to claim 1, further comprising:

a valve block including control valves of the first and second hydraulic circuit systems;

an auxiliary actuator port provided in the valve block and connected to an auxiliary actuator; and an external line port connected to an external line, wherein the second-working-actuator acceleration control valve is provided in a position inside the valve block the auxiliary actuator port and the external line port, and the flow channel is connected to the entrance port side of the second working control valve via the external line port and the external line.

5. The control valve apparatus of the power shovel according to claim 1, wherein the second-working-actuator acceleration control valve is switchable to the first priority position, the second priority position, and an auxiliary position in which a pressure fluid is supplied to an auxiliary actuator, and the second-working-actuator acceleration control valve switches to a position between the first and second priority positions, where an effect of the pilot pressure of the one pilot chamber and an effect of the pilot pressure of the other pilot chamber are balanced.

* * * * *